United States Patent [19]

Watson et al.

[11] 4,224,066

[45] Sep. 23, 1980

[54] COPPER BASE ALLOY AND PROCESS

[75] Inventors: W. Gary Watson, Cheshire; John F. Breedis, Trumbull, both of Conn.

[73] Assignee: Olin Corporation, New Haven, Conn.

[21] Appl. No.: 52,291

[22] Filed: Jun. 26, 1979

[51] Int. Cl.[2] ..... C22C 9/00; C22F 1/08

[52] U.S. Cl. ..... 75/153; 148/2; 148/11.5 C; 148/12.7 C

[58] Field of Search ..... 75/153; 148/11.5 C, 148/12.7 C, 160, 32.5, 11.5 R, 2

[56] References Cited

U.S. PATENT DOCUMENTS

| | | | |
|---|---|---|---|
| 2,025,662 | 12/1935 | Hensel et al. | 75/153 |
| 2,137,281 | 11/1938 | Hensel et al. | 75/159 |
| 2,147,844 | 2/1939 | Kelly | 148/32 |
| 2,172,009 | 9/1939 | Kenny | 75/76 |
| 2,307,512 | 1/1943 | Kelly | 75/153 |
| 2,842,438 | 7/1958 | Saarivirta et al. | 75/153 |
| 2,879,191 | 3/1959 | Nippert et al. | 148/11.5 |
| 3,143,442 | 8/1964 | Watts | 148/160 |
| 3,194,655 | 7/1965 | Pels et al. | 75/135 |
| 3,357,824 | 12/1967 | Saarivirta | 75/153 |
| 3,392,016 | 7/1968 | Opie et al. | 75/153 |
| 3,535,094 | 10/1970 | Opie et al. | 428/636 |
| 3,546,363 | 12/1970 | Pryor et al. | 75/153 |
| 3,615,374 | 10/1971 | Greenwald, Jr. | 75/162 |
| 3,717,511 | 2/1973 | Wallbaum | 148/11.5 R |
| 3,726,673 | 4/1973 | Greenwald, Jr. | 75/153 |
| 4,047,980 | 9/1977 | Watson et al. | 148/12.7 C |
| 4,049,426 | 9/1977 | Watson et al. | 75/153 |
| 4,067,750 | 1/1978 | Mravic et al. | 148/12.7 C |

FOREIGN PATENT DOCUMENTS

| | | | |
|---|---|---|---|
| 1160634 | 1/1964 | Fed. Rep. of Germany | 75/153 |

*Primary Examiner*—L. Dewayne Rutledge
*Assistant Examiner*—Peter K. Skiff
*Attorney, Agent, or Firm*—Paul Weinstein

[57] ABSTRACT

A copper base alloy and process having high strength, high electrical conductivity and reduced quench sensitivity. The alloy consists essentially of from about 0.05 to 1.25% by weight chromium, from about 0.05 to 1.0% by weight zirconium, from about 0.01 to 0.15% by weight iron, and the balance essentially copper.

11 Claims, 2 Drawing Figures

COPPER BASE ALLOY AND PROCESS

BACKGROUND OF THE INVENTION

This invention relates to copper base alloys which are capable of attaining both high strength and high electrical conductivity through control of the precipitation hardening characteristics of the alloy.

The copper base alloy contains small additions of chromium, zirconium and iron. The iron addition serves to reduce the quench sensitivity of the alloy by slowing down the precipitation kinetics.

PRIOR ART STATEMENT

Copper base alloys containing zirconium or zirconium and chromium are known as illustrated in U.S. Pat. Nos. 2,025,662 to Hensel et al., 2,842,438 to Saarivirta et al., 2,879,191 to Nippert et al. and 3,194,655 to Pels et al.

Various addition elements such as magnesium, arsenic, silicon and niobium have been added to chromium-zirconium-copper alloys as set forth in the following U.S. Pat. Nos. 3,143,442 to Watts, 3,357,824 Saarivirta, 3,535,094 and 3,392,016 to Opie et al. and 4,049,426 to Watson et al. Watson et al, suggest that for a copper-chromium-zirconium-niobium alloy the addition of a small but effective amount of an element selected from arsenic, magnesium, cobalt, boron, calcium, cadmium and mischmetal are effective to control precipitation response of the alloy.

Typical processing for copper-chromium-zirconium alloys as above involves a solution anneal followed by quenching, followed by working and/or aging. In place of the solution anneal a hot working followed by quenching is also known. These processes are fully illustrated in the above-identified patents as well as in U.S. Pat. Nos. 3,717,511 to Wallbaum and 4,047,980 to Watson et al.

It has been found particularly desirable from a commercial processing point of view to utilize the hot working operation as the solution treatment step. However, the rapid precipitation kinetics of copper-chromium-zirconium type alloys at hot rolling temperatures can result in precipitates which are too coarse for strengthening. Further, practical quenching rates following the finish pass on the hot mill may not be sufficiently rapid to retain the additive elements completely in solution. This problem of quench sensitivity has been found to be reduced in accordance with this invention through a small addition of iron. While a variety of elements as set forth in the Watson et al. 4,049,426 patent above are known to influence the precipitation kinetics of a chromium-zirconium-niobium alloy it has been found in accordance with this invention that the use of iron provides an alloy with reduced quench sensitivity which need not contain niobium.

German Auslegeschrift No. 1,160,634 relates to a copper-zirconium-niobium alloy which may include 0.01 to 0.1% beryllium and/or iron and/or cobalt, rare earth, indium and/or nickel.

U.S. Pat. Nos. 3,615,374 and 3,726,673 to Greenwald are of interest as showing copper-zirconium-aluminum alloys including trace amounts of chromium and iron. U.S. Pat. No. 2,137,281 to Hensel et al. is of interest as disclosing a copper-zirconium alloy with an addition of 0.1 to 5% of an element selected from iron, cobalt or nickel. Of somewhat lesser interest are believed to be U.S. Pat. Nos. 2,172,009 to Kenny and 2,147,844 to Kelly. Kenny discloses a process for refining copper including reacting phosphorus with molten copper in the presence of an addes substance selected from iron and aluminum not exceeding 0.1%. Kelly discloses the addition of iron and cobalt to a high copper alloy.

SUMMARY OF THE INVENTION

In accordance with this invention a copper base alloy has been provided having high strength and high electrical conductivity. The alloy consists essentially of about 0.05 to 1.25% by weight chromium, about 0.05 to 1.0% by weight zirconium, about 0.01 to 0.15% by weight iron and the balance essentially copper. Preferably, the alloy consists essentially of about 0.5 to 1% by weight chromium, about 0.1 to 0.3% by weight zirconium, about 0.04 to 0.1% by weight iron and the balance copper. Most preferably, the iron content is maintained in a range of about 0.05 to 0.09% and the zirconium content is from about 0.1 to 0.2% by weight.

The aforenoted alloys in the cold rolled and annealed condition have an electrical conductivity of at least about 80% IACS and preferably, at least about 85% IACS. In the rolled temper with an additional 75% cold working the alloys electrical conductivity is at least about 70% IACS and preferably, at least about 75% IACS. In the annealed condition the alloy will have a 0.2% offset yield strength of at least about 70 ksi, an ultimate tensile strength of at least about 75 ksi and an elongation of at least about 12%. In the rolled temper it will have a yield strength of at least about 85 ksi, an ultimate tensile strength of at least about 90 ksi and an elongation of at least about 1.3%.

The alloy is preferably processed in accordance with this invention by casting in a conventional manner followed by hot working at a temperature of from about 930° C. to 1000° C. and preferably, at a temperature of from about 950° C. to 970° C. The finishing temperature after hot working should be greater than about 700° C. and preferably, greater than about 800° C. in order to maximize the solid solution of the alloying elements. The hot worked material at the finishing temperature is then rapidly cooled, as by a spray quench, to a temperature less than about 300° C. The cooled material is then cold rolled greater than about 60% and preferably greater than about 70%. This is followed by aging at a temperature of from about 350° to 550° C. for a period of greater than about 30 minutes and preferably, at a temperature of from about 400° to 500° C. for a period of from about 1 to 24 hours. Optionally, the alloy may then be cold rolled to temper an amount less than about 90%.

While hot working to effect solutionizing of the alloying elements is the preferred processing in accordance with this invention if desired the alloy could be processed in accordance with any well known process and a solution anneal could be substituted for the hot working solutionizing treatment as described.

Accordingly, it is an object of this invention to provide an improved copper base alloy and process for providing high conductivity, high strength and improved resistance to quench sensitivity.

It is a further object of this invention to provide an alloy and process as above which is adapted to utilize hot working as a solutionizing treatment.

It is a further object of this invention to provide an alloy and process as above containing additions of chromium, zirconium and iron within critical limits to a copper base.

These and other objects will become apparent from the following drawings and description.

DETAILED DESCRIPTION OF PREFERRED EMBODIMENTS

Figure 1:
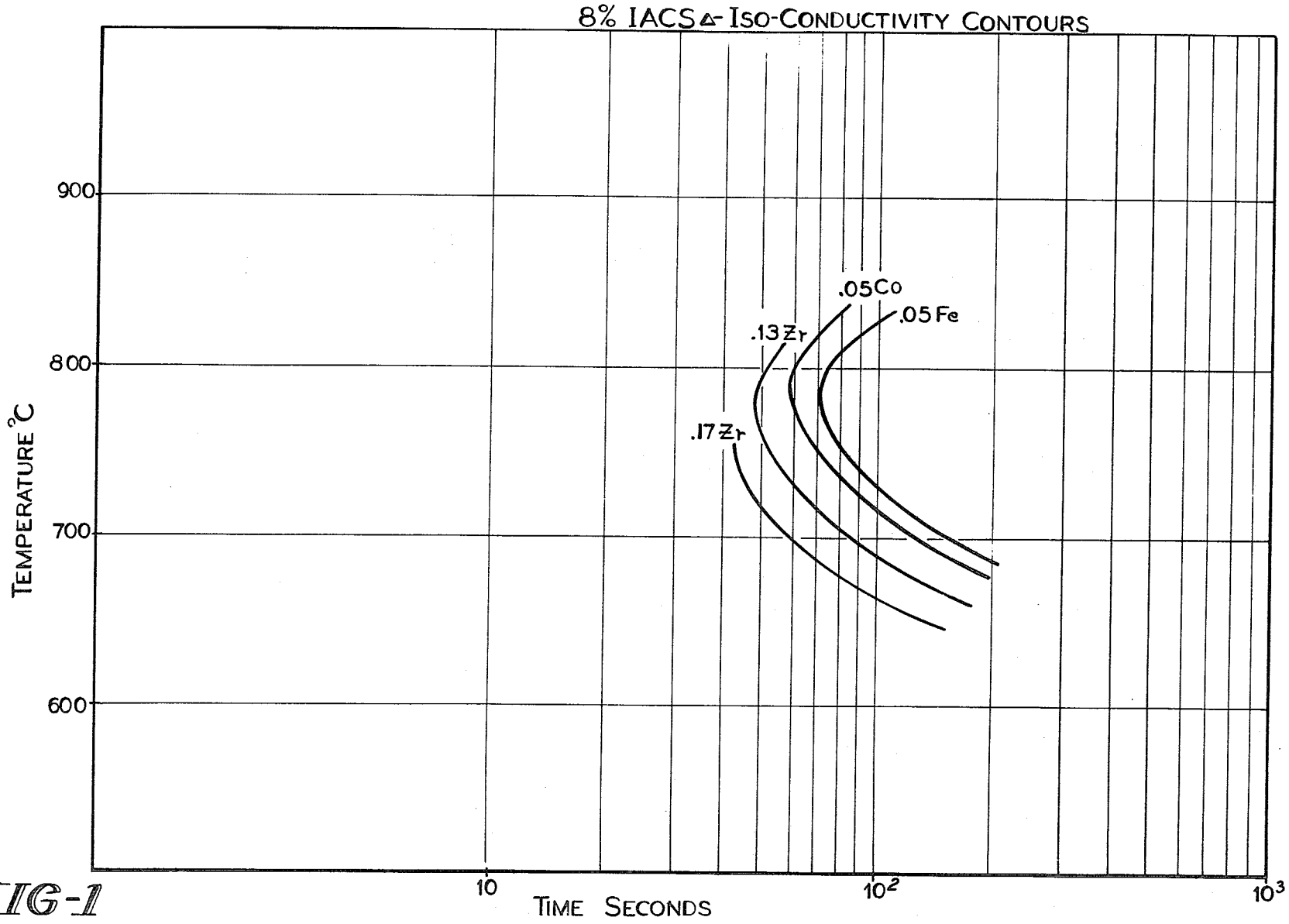
FIG. 1 is a semi-log plot of Δ-isoconductivity contours for a series of copper base alloys which illustrate the reduced quench sensitivity of the alloys of this invention.

Copper base alloys which contain 0.05 to 1.25% chromium and 0.05 to 1.0% zirconium are capable of attaining both high strength and high electrical conductivity. In order to achieve the highest strength through precipitation hardening the alloy requires a high temperature solution anneal above 900° C. to place sufficient chromium and zirconium in solid solution. This must be followed by a rapid quench to retain these elements in solution before subsequent precipitation or aging heat treatment. The solutionizing treatment can be performed either by a solution anneal followed by a rapid quench or by solutionizing during hot working followed by a rapid quench. This latter approach is particularly preferred from a commercial point of view. However, solutionizing by hot working imposes an upper limit on attainable strength since the characteristically rapid precipitation kinetics or quench sensitivity of this alloy at hot rolling temperatures can result in precipitates which are too coarse for strengthening.

The alloys inherent quench sensitivity has been found to be reduced in accordance with this invention through a small addition of iron. The effect of an iron addition of from about 0.01 to 0.15% by weight and, preferably, from about 0.04 to 0.1% and, most preferably, from about 0.05 to 0.09% is to slow the elevated temperature precipitation kinetics of a copper-chromium-zirconium alloy.

The alloy of this invention consists essentially of about 0.05 to 1.25% by weight chromium, about 0.05 to 1.0% by weight zirconium, about 0.01 to 0.15% by weight iron and the balance essentially copper.

Preferably, in accordance with this invention the alloy has a composition of from about 0.5 to 1% by weight chromium, from about 0.1 to 0.3% by weight zirconium, from about 0.04% to 0.1% by weight iron and the balance essentially copper. Most preferably, the iron content of the aforenoted alloy is maintained within a range of from about 0.05 to about 0.09% and the zirconium is from about 0.1 to 0.2%.

Additions of chromium and zirconium below the amounts set forth above result in reduced strength for the resulting alloy. Additions of chromium in excess of the amounts set forth above will cause reduced electrical conductivity. An addition of zirconium in excess of the amounts set forth above will result in hot rolling difficulties because zirconium has a low melting point eutectic and also in reduced electrical conductivity. The addition of iron below the amounts set forth above will result in increased quench sensitivity. Exceeding the amounts of iron set forth above will result in lower electrical conductivity.

The elements within the aforenoted ranges, should in every sense be deemed to be critical for obtaining the desired properties of high strength, high conductivity and reduced quench sensitivity.

In order to evaluate the effect of the iron addition on the alloys of this invention a series of alloys having compositions as shown in Table I were cast.

TABLE I

| Ingot Number | Composition Weight Percent | | | |
|---|---|---|---|---|
| | Cr | Zr | Co | Fe |
| C674 | 0.51 | 0.13 | — | — |
| C675 | 0.50 | 0.17 | — | — |
| C752 | 0.50 | 0.12 | 0.05 | — |
| C753 | 0.50 | 0.14 | — | 0.05 |

Figure 2:
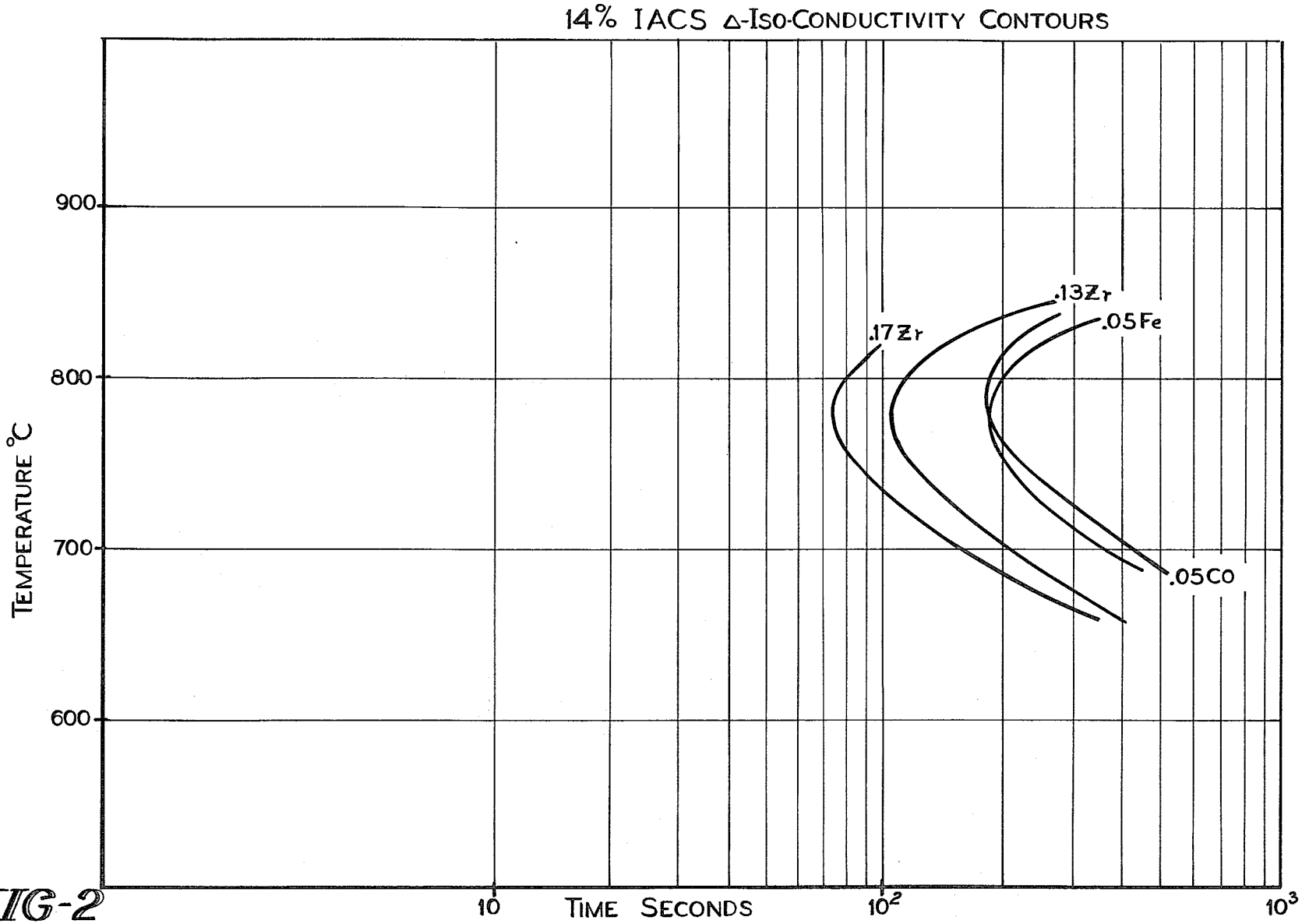
FIG. 2 is a semi-log plot of Δ-isoconductivity contours for a series of copper base alloys with increased precipitation showing the reduced quench sensitivity of the alloys of this invention.

The alloys in Table I were laboratory cast under an argon atmosphere to form approximately 5 pound ingots. The ingots were then hot and cold rolled into strip 0.030" thick. Sample strips were taken from each of the rolled alloys for determining the Δ-isoconductivity curves as set forth in FIGS. 1 and 2. In FIGS. 1 and 2 the curves labeled: 0.13Zr corresponds to Alloy C674; 17Zr corresponds to Alloy C675; 0.05Co corresponds to Alloy C752; and 0.05Fe corresponds to Alloy C753.

The samples of the alloys set forth in Table I were solution treated at 950° C. for 30 to 45 minutes. They were then quenched in a salt bath maintained at a desired temperature and held in the salt bath for a desired period of time. The samples were then cooled rapidly to room temperature and their conductivity measured. The curves of FIGS. 1 and 2 were generated by selecting different holding time periods in the bath and different bath temperatures for a variety of samples. The information was then plotted as in FIGS. 1 and 2 based upon data for samples which resulted respectively in an 8% or a 14% change in conductivity as compared to solution annealed plus quenched to room temperature values for each of the alloys. The total conductivity change from a fully solutionized condition to a fully precipitated condition for these alloys is approximately 55%.

The Δ-isoconductivity curves are believed to be indicative of the time and temperature relationships for each of the alloys for achieving a given amount of precipitation. It is believed that the change in conductivity in a corresponding measure of the degree of precipitation in the alloys since electrical conductivity is affected directly by the amounts of alloying elements retained in solid solution. It has been found that there is a correlation between the data obtained for the solution treated and quenched samples as described above and material processed by the desired commercial processing wherein the solutionizing is performed as part of the hot working of the alloy.

FIG. 1 is more representative than FIG. 2 of the precipitation kinetics of the respective alloys at a time close to the onset of precipitation. The 8% change in conductivity of FIG. 1 means that less precipitation occurred than for the 14% change in conductivity of FIG. 2.

Referring to FIG. 1, therefore, it is apparent that at a time close to the onset of precipitation an addition of 0.05% iron slows the precipitation kinetics of the alloy of this invention by over 20 seconds as compared to an alloy with 0.13% zirconium and by nearly 30 seconds as compared to an alloy with 0.17% zirconium. Surprisingly the precipitation kinetics are slowed by greater than 10 seconds for an iron containing alloy as compared to one containing cobalt. Further, increasing the level of zirconium of from 0.13% to 0.17% by weight has the effect of speeding up the precipitation kinetics.

Referring now to FIG. 2 which is representative of a point later in the precipitation process wherein a greater amount of precipitation has taken place it is apparent that the iron addition slows the precipitation kinetics of the alloy of this invention on the order of about 70 seconds as compared to a 0.13% zirconium alloy. Increasing the zirconium content from 0.13% to 0.17% results in an additional 30 second slowing of the precipitation kinetics as compared to the alloy with 0.13% zirconium.

It is, therefore, apparent that the alloys in accordance with this invention including iron within the aforenoted critical limits provide a significant improvement in the retardation of elevated temperature precipitation in the alloy. It is also apparent that the zirconium content exhibits a significant influence on precipitation kinetics and should preferably be maintained below the preferred limits of this invention.

The ingots were hot rolled from 950° C. to about ½" thickness strips at a finishing temperature of about 700° C. and then water quenched. The ½" strips were milled to about 0.4". The strips were then re-solution heat treated at about 950° C. for 30 to 45 minutes followed by a water quench. The solution treated alloy strips were cold rolled 75% and aged at 450° C. for 8 hours and their electrical conductivity measured. The aged materials were then cold rolled an additional 75% to a super spring temper and their tensile and electrical properties measured. The results of these tests are set forth in Table II.

TABLE II

| | Alloy As Aged | | Alloy In Spring Temper | | |
|---|---|---|---|---|---|
| Alloy | Electrical Conductivity % IACS | Ultimate Tensile Strength ksi* | 0.2% Offset Yield Strength ksi* | Elongation % over 2" Gage Length | Electrical Conductivity % IACS |
| C674 | 86 | 89 | 84 | 3 | 76.5 |
| C675 | 86 | 91 | 85.5 | 4 | 77 |
| C753 | 82.5 | 92 | 87.5 | 3.5 | 73.5 |

*ksi = 1000 pounds per square inch

It has been found in accordance with this invention that not only are the precipitation kinetics of the alloy at elevated temperature influenced but also the precipitation kinetics during a precipitation anneal. Therefore, in accordance with this invention when the alloy is precipitation annealed for the same mount of time as a chromium-zirconium alloy without the addition of iron it will generally have a higher strength and a somewhat lower though still high conductivity as shown in Table II. However, it is possible by extending the annealing time to a longer period to obtain conductivity levels similar to the chromium-zirconium alloys without iron.

The aforenoted laboratory processing can be employed with the alloy of this invention, however, preferably the alloy is processed as follows. It is cast by conventional means; however, the zirconium addition is made in the launder by using a feed wire. The alloy is hot worked as quickly as possible. Preferably, the initial hot working temperature is from about 930° C. to about 1000° C. and, most preferably, from 950° to 970° C. The alloy should finish the hot working at a temperature greater than about 700° C. and, preferably, greater than about 800° C. in order to maximize the solutionizing of the respective alloying elements. The alloy is quenched following the hot working to a temperature below about 300° C. In practice this quenching may be performed by a spray quenching arrangement following the hot working mill. After hot working the strip material is milled to remove oxides and undesired material and then cold rolled an amount greater than about 60% and, preferably, greater than about 70%. The cold rolled material is precipitation annealed or aged at a temperature of from about 350° to 550° C. for a period greater than 30 minutes and, preferably, at a temperature of from about 400° to 500° C. for a period of from about 1 to 24 hours. The alloy in the aged condition will have an electrical conductivity of at least about 80% and, preferably, at least about 85%. It will have a yield strength at 0.2% offset of at least about 70 ksi, an ultimate tensile strength of at least about 75 ksi and an elongation of at least about 12%.

If desired, in accordance with this invention the alloy can be placed in a spring temper by optionally cold rolling it an amount less than about 90% and, preferably, greater than about 50%. In the spring temper following about 75% cold reduction the alloy will have an electrical conductivity of at least about 70% and, preferably, at least about 75%. It will also have a yield strength at 0.2% offset of at least about 85 ksi, an ultimate tensile strength of at least about 90 ksi, and an elongation of at least about 1½ to 3%.

All percentages of composition as set forth above are percentges by weight.

If desired, additional elements may be added to this alloy which will not adversely affect the desired properties. It has been found that the addition of iron as set forth above has a similar beneficial effect when added to alloys including niobium as in the Watson et al. 4,049,426 patent. Further, it is believed that other elements known to affect the precipitation kinetics of chromium-zirconium containing alloys are arsenic, magnesium, cobalt, boron, calcium, cadmium and mischmetal as set forth in the Watson et al. 4,049,426 patent may be added in a small but effective amounts which will not adversely affect the properties of the alloy.

It is apparent that there has been provided in accordance with this invention a copper base alloy and process which fully satisfies the objects, means and advantages set forth hereinbefore. While the invention has been described in combination with specific embodiments thereof, it is evident that many alternatives, modifications and variations will be apparent to those skilled in the art in the light of the foregoing description. Accordingly, it is intended to embrace all such alternatives, modifications and variations as fall within the spirit and broad scope of the appended claims.

What is claimed is:

1. A copper base alloy having high strength, high electrical conductivity and reduced quench sensitivity, consisting essentially of from about 0.05 to 1.25% by weight chromiun, from about 0.05 to 1.0% by weight zirconium, from about 0.01 to 0.15% by weight iron, and the balance essentially copper.

2. An alloy as in claim 1 consisting essentially of chromium from about 0.5 to 1.0%, zirconium from about 0.1 to 0.3%, iron from about 0.04 to 0.1%, and the balance essentially copper.

3. An alloy as in claim 2 wherein said iron is from about 0.05 to 0.09% and said zirconium is from about 0.1 to 0.2%.

4. An alloy as in claim 1 which is in the hot worked and quenched condition.

5. An alloy as in claim 4 which is further in a cold worked and precipitation annealed condition.

6. An alloy as in claim 5 which is further in a cold rolled temper condition.

7. A process of forming a copper base alloy comprising:

casting an alloy consisting essentially of chromium from about 0.05 to 1.25% by weight, zirconium from about 0.05 to 1.0% by weight, iron from about 0.01 to 0.15% by weight, and the balance essentially copper;

hot working said alloy with an initial temperature of from about 930° C. to 1000° C. and with a finishing temperature greater than about 700° C;

quenching said hot worked alloy from said finishing temperature to a temperature less than about 300° C;

precipitation annealing said alloy at a temperature from about 350° C. to 550° C. for a period of greater than 30 minutes.

8. A process as in claim 7 wherein prior to said precipitation annealing step, said alloy is cold rolled greater than about 60%.

9. A process as in claim 8 wherein subsequent to said precipitation annealing step, said alloy is cold rolled to temper an amount less than about 90%.

10. A process as in claim 7 wherein said alloy consists essentially of chromium from about 0.5 to 1.0%, zirconium from about 0.1 to 0.3%, iron from about 0.04 to 0.1%, and the balance essentially copper.

11. A process as in claim 10 wherein said iron is from about 0.05 to 0.09% and said zirconium is from about 0.1 to 0.2%.

* * * * *